US006824208B2

(12) United States Patent
Zheng

(10) Patent No.: US 6,824,208 B2
(45) Date of Patent: Nov. 30, 2004

(54) SINGLE-MOTION COLLAPSIBLE QUAD CHAIR WITH SOLID ARMREST

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/469,462

(22) PCT Filed: Mar. 2, 2001

(86) PCT No.: PCT/US01/06892

§ 371 (c)(1),
(2), (4) Date: Feb. 9, 2004

(87) PCT Pub. No.: WO02/069761

PCT Pub. Date: Sep. 12, 2002

(65) Prior Publication Data

US 2004/0130190 A1 Jul. 8, 2004

(51) Int. Cl.[7] ..... A47C 4/00
(52) U.S. Cl. ..... 297/38; 297/16.2; 297/56
(58) Field of Search ..... 297/38, 45, 56, 297/16.2

(56) References Cited

U.S. PATENT DOCUMENTS

| | | | | | |
|---|---|---|---|---|---|
| 3,635,520 | A | * | 1/1972 | Roher et al. | 297/45 |
| D247,618 | S | | 3/1978 | Sparkes | |
| 4,317,581 | A | | 3/1982 | Kassai | |
| 4,613,185 | A | | 9/1986 | Marchesini et al. | |
| 5,058,950 | A | | 10/1991 | Mann | |
| 5,893,605 | A | * | 4/1999 | Chang | 297/16.2 |
| 5,899,525 | A | | 5/1999 | Tseng | |
| 5,947,553 | A | | 9/1999 | Tseng | |
| 5,984,406 | A | | 11/1999 | Lee | |
| 6,062,639 | A | | 5/2000 | Hill | |
| 6,082,813 | A | * | 7/2000 | Chen | 297/16.2 |
| 6,149,238 | A | * | 11/2000 | Tsai | 297/411.43 |

* cited by examiner

*Primary Examiner*—Peter R. Brown
(74) *Attorney, Agent, or Firm*—Rutan & Tucker

(57) ABSTRACT

A quad chair (100) with solid armrests (130) collapses in a single movement in which (a) the front legs (110) approximate each other when the front legs and the rear legs (120) pivot towards each other, and (b) the armrest slidingly moves along the front leg, rear leg, or cross brace (150).

17 Claims, 1 Drawing Sheet

FIG. 1
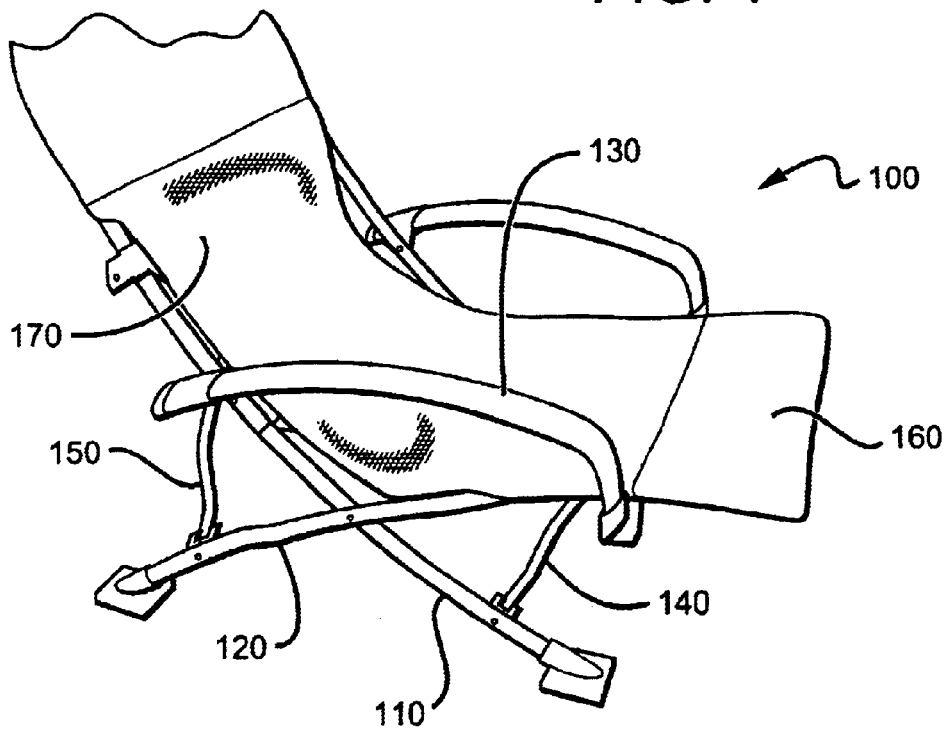
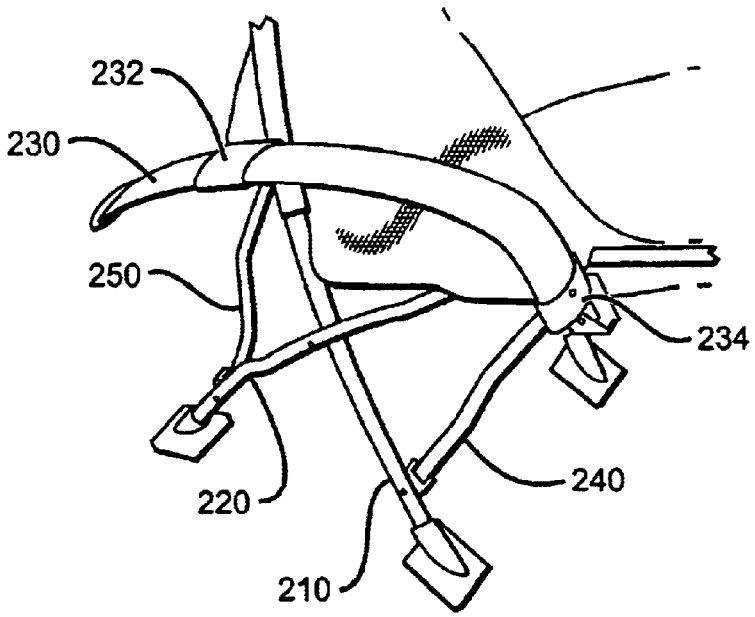
FIG. 2

SINGLE-MOTION COLLAPSIBLE QUAD CHAIR WITH SOLID ARMREST

FIELD OF THE INVENTION

The field of the invention is collapsible furniture.

BACKGROUND OF THE INVENTION

Folding chairs are relatively popular, in part because they can be stored at considerably reduced space requirements when compared to non-folding chairs. Exemplary folding chairs with solid arm rests and seat support rods are described in U.S. Pat. No. 4,613,185 to Marchesini et al. (Sep. 23, 1986), U.S. Pat. No. 5,899,525 to Tseng (May 4, 1999), U.S. Pat. No. 5,947,553 to Tseng (Sep. 7, 1999), and U.S. Pat. No. 6,062,639 to Hill (May 16, 2000), all of which are incorporated by reference herein.

Nevertheless, previously known folding chairs still take up a relatively large space when folded, since the dimension of the folding chair is generally reduced only along one space coordinate (e.g., reduced length). To further reduce the space requirement, collapsible chairs have been developed in which further size reduction is achieved by folding the chair along at least two space coordinates (e.g., length and width). Various collapsing chairs are known in the art.

In U.S. Pat. No. Des 247,618 (Mar. 28, 1978), for example, Sparkes describes a collapsible stroller with solid armrests and seat support rods that is first folded in a front to back motion and then folded in a side-to-side motion. Although Sparkes' stroller provides substantial space saving over non-collapsible strollers, the collapsing is relatively cumbersome since both halves of the chair have to be rotated relative to each other. Improved collapsibility can be achieved by including a detachable connector element into a structure that couples foldable halves of the stroller as described in U.S. Pat. No. 4,317,581 to Kassai (Mar. 2, 1982). Uncoupling of the detachable element advantageously simplifies side-to-side folding of the stroller. However, Kassai's stroller nevertheless requires at least two folding operations to collapse the stroller.

To avoid at least some of the problems associated with multiple operations of collapsible chairs, Mann describes in U.S. Pat. No. 5,058,950 (Oct. 22, 1991) the use of hinges in both armrests and seat support rods. Mann's chair can be collapsed in a single side-to-side and front-to-back motion, however, the hinges in the armrests may be uncomfortable for at least some of the users. Moreover, due to the particular configuration of movable elements in the chair, front and back seat support rods are perpendicular to the legs of a person sitting in the chair, which will likely restrict blood flow in the legs of almost all users over a prolonged period.

Although there are various collapsible chairs with solid armrests known in the art, all or almost all of them suffer from one or more disadvantages. Therefore, there is a need to provide improved methods and apparatus for collapsible chairs with solid armrests.

SUMMARY OF THE INVENTION

The present invention is directed to a collapsible chair having solid armrests that can be collapsed in a single motion, wherein contemplated collapsible chairs are preferably configured as a quad with the arm rests slidably coupled to the quad.

In particular, contemplated collapsible chairs have a pair of front legs, a pair of rear legs, and a pair of solid arm rests, wherein a backrest and a first cross brace are coupled to the front legs, and a seat and a second cross brace are coupled to the rear legs. The armrests are slidably coupled to the front legs, the rear legs, the first cross brace, or the second cross brace, such that the chair collapses in a single movement in which the front legs approximate each other when the front legs and the rear legs pivot towards each other.

In one aspect of the inventive subject matter, the solid armrest is slidably coupled to at least one of the front legs, and it is further preferred that the solid armrest is arcuate. It is also contemplated that the solid armrest is rotatably coupled to one of the rear legs, and slidably coupled to one of the front legs.

In another aspect of the inventive subject matter, the backrest and the seat are coupled to each other to form a continuous supporting surface, and are preferably fabricated from a weather resistant material. It is further contemplated that the seat is a tensioned seat. In a further aspect of the inventive subject matter, the front legs and the rear legs are rotatably coupled to each other, and where the front and back legs are coupled to each other via cross braces, it is preferred that the front legs, the rear legs, and the first and second cross brace form a quad.

In a still further aspect of the inventive subject matter, a method of imparting collapsibility into a chair comprises one step in which a pair of front legs, a pair of rear legs, and an arcuate solid armrest are provided. In another step, a first cross brace is coupled to the front legs, and a second cross brace is coupled to the rear legs to form a quad, and in still another step, the arcuate arm rest is slidably coupled to at least one of the front legs, rear legs, first cross brace, and second cross brace such that such that the chair collapses in a single movement in which the front legs approximate each other when the front legs and the rear legs pivot towards each other.

Various objects, features, aspects and advantages of the present invention will become more apparent from the following detailed description of preferred embodiments of the invention, along with the accompanying drawing, in which like numerals represent like components.

BRIEF DESCRIPTION OF THE DRAWING

FIG. 1 is a perspective view of a collapsible chair.

FIG. 2 is a perspective detail view of the collapsible chair of FIG. 1.

DETAILED DESCRIPTION

It is generally contemplated that a collapsible chair includes a pair of front legs, a pair of rear legs, and a pair of solid arm rests. Contemplated collapsible chairs further include a backrest and a first cross brace coupled to the front legs, and a seat and a second cross brace coupled to the rear legs, wherein the solid armrest is slidably coupled to at least one of the front legs, the rear legs, the first cross brace, and the second cross brace, such that the chair collapses in a single movement in which the front legs approximate each other when the front legs and the rear legs pivot towards each other.

In a particularly preferred aspect of the inventive subject matter as depicted in FIG. 1, a collapsible chair 100 has a pair of front legs 110 (only one front leg shown), a pair of rear legs 120 (only one rear leg shown), and a pair of solid arm rests 130. A first cross brace 140 is coupled to the front legs, and a second cross brace 150 is coupled to the rear legs. A tensioned seat 160 is coupled to the rear legs, and a back rest 170 is coupled to the front legs, wherein the tensioned seat 160 and the back rest 170 are coupled to each other to form a continuous supporting surface.

A preferred manner of coupling the solid armrest, the front legs, the rear legs, and the cross braces is depicted in FIG. 2, which is a detail view of the chair of FIG. 1. Here, each front leg 210 is rotatably coupled to a rear leg 220, and a pair of first cross braces 240 couples the front legs to the rear legs (on the laterally opposing sides of the chair), wherein each of the first cross braces is rotatably coupled to a lower portion of a front leg, and rotatably and slidably coupled to a rear leg (on a frontal side of the chair). A second pair of cross braces 250 couples the rear legs to the front legs (on the laterally opposing sides of the chair), wherein the each of the second cross braces is rotatably coupled to a lower portion of a rear leg, and rotatably and slidably coupled to a front leg (on a rear side of the chair). Thus, the front legs and the rear legs are coupled to each other via the first and second pairs of cross braces to form a quad. Each of the arcuate solid arm rests 230 is coupled to the respective front and rear legs via a first and a second arm rest support, 232 and 234, respectively, wherein the first arm rest support 232 is rotatably coupled to the front leg and the second arm rest support 234 is coupled to the rear leg. The first armrest support 232 slidingly engages with the solid armrest, while the second armrest support rotatably retains the solid armrest in a fixed position.

It is especially contemplated that the seat and the backrest are fabricated from a weather resistant material or fabric, preferably a woven synthetic polymer (e.g., Nylon) and is uniformly colored (e.g., blue). Particularly preferred seats have a width of about 26 inches and an overall length of about 28 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 26 inches, and suitable widths include 26–28, 28–30, and 30–40 inches, and wider, but also 20–26, 15–20, and 12–15 inches, and narrower. Likewise, the length of appropriate seats may vary between 28–24, 24–18, and 12–18 inches and less, but also between 28–30, 30–35, and more. It should further be appreciated that contemplated seats may also be tapered from the front end to the back end, or vice versa.

With respect to the backrest it is contemplated that all materials suitable for the seat are also suitable for the backrest, and it is generally preferred that the backrest is fabricated from the same material as the seat. It is further contemplated that the backrest is removably or permanently coupled to the seat (e.g., sewed, coupled with a zipper, etc.) Thus, it is preferred that the backrest has a width of about 26 inches. A preferred height of the backrest is about 24 inches. With respect to the material and color, it is contemplated that the same considerations as for the seat apply. It is further contemplated that the width and height of suitable backrests may vary, and that width and height will depend among other things on the persons' size and the number of persons to be seated in the chair. Thus, alternative backrests may have a width between 18–26 inches and less, but also between 26–33 and more. Similarly, contemplated backrests may have a height between 12–24 inches and less, but also between 24–30 inches and more.

It is generally contemplated that the seat and the backrest may be coupled to the front and rear legs in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadbly securable elements (e.g., laces threaded through rings). Permanent couplings include sewed or glued elements. For example, the backrest may permanently coupled to the chair via a rivet. On the other hand, the front end of the seat may be temporarily coupled to the rear legs via ring-shaped openings that are slid over the top ends of the rear legs. It is further particularly preferred that the seat and the backrest are coupled together to form a continuous supporting surface.

It should further be appreciated that the attachment of the seat and/or the backrest to the chair may be directly or indirectly. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the rear legs via a slidable pouch. Alternatively, the seat may be indirectly coupled to the rear legs via a ring-shaped opening in the seat that slidably engages with the rear legs.

With respect to the legs, armrests, armrest supports, and cross braces of contemplated chairs, it should be appreciated that all of these elements may be manufactured from various materials, including metals, metal alloys, natural and synthetic polymers, and any reasonable combination thereof. However, it is preferred that the legs, back support rods, seat support rods, and cross braces are manufactured from black anodized aluminum tubing with a wall strength of about 1/32 inch and an outer diameter of approximately ½ inch. It is also preferred that the solid armrest is fabricated from a recycled molded thermoplastic polymer, and especially preferred alternative materials for the armrest, legs, support rods, and cross braces include stainless steel, fiberglass, and wood. As used herein, the term "solid armrest" means that the armrest is fabricated from a sufficiently stiff material to substantially maintain the shape of the armrest while the chair is being folded or unfolded. For example, a wooden or metal armrest is considered a solid armrest under the scope of this definition, because such armrests are fabricated from a material with sufficient stiffness to maintain the shape of the armrest. In contrast, a woven or textile armrest, is not considered a solid armrest under the scope of this definition because such armrests will deform (i.e. change their shape) while the chair is folded or unfolded.

Where at least one of the armrests, front or rear legs, or cross braces are rotatably or pivotally coupled to another one of the armrests, front or rear legs, or cross braces, it is generally contemplated, that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Similarly, where one of the armrests, front or rear legs, or cross braces are slidably coupled to another one of the armrests, front or rear legs, or cross braces, all known slidable couplings are contemplated to be appropriate, and include a sliding sleeve, slide rails, guiding rings, etc.

It should further be recognized that contemplated couplings may be realized in various configurations. For example, rotatable couplings may include couplings that are also slideable relative to their point of attachment. For example, contemplated alternative rotatable couplings may include a sleeve that is slideably coupled. Thus, it should be appreciated that contemplated couplings may be rotatable and slidable. Alternatively, where rotatable and slidable couplings are less desirable, temporary couplings may be employed and suitable temporary couplings include snap connectors, connectors that are secured with a pin or other removable element, etc.

It is generally contemplated that various methods and configurations may be employed to impart collapsibility into contemplated chairs with solid armrests. Thus, an arcuate solid armrest need not be limited to a configuration in which a first armrest support slidingly engages with the solid armrest, while the second armrest support rotatably retains the solid armrest in a fixed position (see FIG. 2). Alternative configurations may include a two armrest supports that slidingly engage with the solid armrest. In another example, the solid armrest may be hingedly attached to the rear leg, while slidably coupled to a single armrest support. Alternatively, a portion, or the entire solid armrest may be telescoping and is rotatably attached to the front and rear leg.

It is generally contemplated that the armrest, the cross braces, the front legs and the rear legs are coupled in a manner that allows collapsing the chair in a single movement, i.e., that the front legs approximate each other as the front legs and the rear legs pivot towards each other. As viewed from another perspective, the seat pivots upwardly and the rear legs leg pivot towards the pair of front legs, when the chair folds into a closed configuration.

In alternative aspects of the inventive subject matter the number of front legs, rear legs, and/or cross braces may vary considerably. For example, where the chair is sized and dimensioned to accommodate more than one person, three, four, or more front and/or rear legs, and/or cross braces may be included. On the other hand, where stability of the seat is particularly desirable, additional seat support rods may be included in a chair with two front legs and two rear legs. Likewise, the number of cross braces may vary, and while some chairs may have only one pair of cross braces, other chairs may include three, four, or more cross braces.

It should be especially appreciated that in preferred configurations of collapsible chairs the seat is tensioned when the front legs move apart, and that the seat remains substantially tensioned when the seat supports a person. The term "tensioned seat" means that the seat is substantially level when the chair is in the open configuration, wherein the term "substantially level" means that the vertical distance between any point of the seat and the rear leg is no more than one 2 inches, more preferably no more than 1 inch, and most preferably no more than 0.5 inch. The term "open configuration" refers to the configuration of the collapsible chair in which the front legs have a maximum distance from each other when the chair is opened using reasonable force (i.e. without damaging the mechanical structure). The term "remains substantially tensioned" means that the vertical distance between the lowest point of the seat and the rear leg increases no more than one inch, preferably no more than two inches, more preferably no more than 1 inch, and most preferably no more than 0.5 inch. Thus, it should be recognized that the tension of the seat is predominantly determined by the firmness of the material of the seat.

While not whishing to be bound by a particular theory, it is contemplated that the tension in the seat remains substantially tensioned due to mechanically coupling an approximating movement of the rear legs with a simultaneous movement of at least one of the rear legs relative to the front leg and a movement of at least one cross brace. Viewed from another perspective, it should be recognized that contemplated modes of coupling the front leg with the rear leg prevent loss of tension of the seat when a person is supported by the chair.

Thus, a method of imparting collapsibility into a chair having a solid armrest has one step in which a pair of front legs, a pair of rear legs, and an arcuate solid armrest are provided. In another step, a first cross brace is rotatably (and slidably) coupled to the front legs, and a second cross brace is rotatably (and slidably) coupled to the rear legs to form a quad. In a further step, the arcuate arm rest is slidably coupled to at least one of the front legs, rear legs, first cross brace, and second cross brace such that such that the chair collapses in a single movement in which the front legs approximate each other when the front legs and the rear legs pivot towards each other. The term "quad" as used herein refers to a configuration of a plurality of elements in which four pairs of two elements are coupled to each other form a polygon of four sides, wherein the two elements of each pair are rotatably coupled to each other, and at least one element of one side is slidably coupled to an element of another side.

In especially preferred configurations, the armrest is slidably coupled to at least one of the front legs, a seat (e.g., a tensioned seat) is coupled to the rear leg, and a back rest is coupled to the front leg. It is still further preferred that the seat is coupled to the back rest to form a continuous supporting surface. In still further preferred methods, the arcuate arm rest is rotatably coupled to the rear leg and slidably coupled to the front leg. With respect to the front leg, the rear leg, the cross braces, the seat, the back rest, and the solid armrest, the same considerations as described above apply.

Thus, specific embodiments and applications of single-motion collapsible quad chairs with solid armrests have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising:

a first front leg pivotably coupled to a first rear leg, and a second front leg pivotably coupled to a second rear leg;

a back rest and a first cross brace coupled to the first and second front legs, and a seat and a second cross brace coupled to the first and second rear legs;

a rigid arm rest;

wherein one portion of the rigid armrest is pivotably coupled to at least one of the front legs, the rear legs, the first cross brace, and the second cross brace, wherein another portion of the arm rest is slidably coupled to at least one of the front legs, the rear legs, the first cross brace, and the second cross brace; and wherein the chair collapses in a single movement in which (a) the front legs approximate each other when the front legs and the rear legs pivot towards each other, and (b) in which the rigid arm rest slides relative to the at least one of the front legs, the rear legs, the first cross brace, and the second cross brace.

2. The collapsible chair of claim 1 wherein the solid armrest is slidably coupled to at least one of the front legs.

3. The collapsible chair of claim 1 wherein the solid armrest is arcuate.

4. The collapsible chair of claim 1 wherein the solid arm rest is rotatably coupled to one of the rear legs, and slidably coupled to one of the front legs.

5. The collapsible chair of claim 1 wherein the backrest and the seat are coupled to form a continuous supporting surface.

6. The collapsible chair of claim 1, wherein the seat is a tensioned seat.

7. The collapsible chair of claim 1 wherein at least one of the seat and the backrest is fabricated from a weatherproof material.

8. The collapsible chair of claim 1 wherein the front legs, the rear legs, and the first and second cross brace are fabricated from a metal.

9. The collapsible chair of claim 1 wherein the front legs, the rear legs, and the first and second cross brace are rotatably coupled to form a quad.

10. The collapsible chair of claim 1 wherein the front legs and the rear legs are rotatably coupled to each other.

11. The collapsible chair of claim 1 wherein at least one of the arm rest, the front legs and the rear legs are configured to retain an object selected from the group consisting of a beverage container, a sun protector, and a laptop computer.

12. A method of imparting collapsibility into a chair having a solid armrest, comprising:

providing a first and a second front leg, a first and a second rear leg, and an arcuate rigid armrest;

pivotably coupling the first front leg to the first rear leg, and pivotably coupling the second front leg to the second rear leg;

rotatably coupling a first cross brace to the first and second front legs, and a second cross brace to the first and second rear legs to form a quad;

pivotably coupling one portion of the rigid armrest is to at least one of the front legs, the rear legs, the first cross brace, and the second cross brace, and slidably coupling another portion of the arm rest to at least one of the front legs, the rear legs, the first cross brace, and the second cross brace; and wherein the chair collapses in a single movement in which the front legs approximate each other when the front legs and the rear legs pivot towards each other.

13. The method of claim 12 wherein the arm rest is slidably coupled to at least one of the front legs.

14. The method of claim 12 further comprising coupling a seat to the rear leg, and coupling a back rest to the front leg.

15. The method of claim 14 wherein the seat and the back rest are coupled to each other to form a continuous supporting surface.

16. The method of claim 14 wherein the seat is a tensioned seat.

17. The method of claim 12 wherein the arcuate arm rest is rotatably coupled to the rear leg and slidably coupled to the front leg.

* * * * *